US006010158A

United States Patent [19]

Croteau

[11] Patent Number: 6,010,158

[45] Date of Patent: Jan. 4, 2000

[54] COLLAPSIBLE WORK STATION DEVICE

[76] Inventor: Arthur F. Croteau, 38 Woodland Rd., Cherry Valley, Mass. 01611-3006

[21] Appl. No.: 08/878,271

[22] Filed: Jun. 18, 1997

[51] Int. Cl.[7] ..... B42D 3/00

[52] U.S. Cl. ..... 281/33; 248/456

[58] Field of Search ..... 281/42, 45, 33; 402/73, 4, 80 R; 248/441.1, 445, 447, 454, 456, 460

[56] References Cited

U.S. PATENT DOCUMENTS

| | | | |
|---|---|---|---|
| D. 316,727 | 5/1991 | Greenspahn | D19/52 |
| D. 328,985 | 9/1992 | Sheldon | D6/406 |
| D. 341,958 | 12/1993 | Allred | D6/419 |
| D. 354,636 | 1/1995 | Cable | D19/52 |
| D. 365,461 | 12/1995 | Falter | D6/419 |
| 5,251,935 | 10/1993 | Bottiglieri | 281/45 |
| 5,379,979 | 1/1995 | Due | 281/45 X |

*Primary Examiner*—Willmon Fridie, Jr.

[57] ABSTRACT

A combination slanted writing surface and book holder that is easy to knock down and set up. This folding feature makes for easy storage and carrying. The back support 14, when removed, will store flat on top of the base 12. To collapse, you need to separate the work surface 10 from the back 18, allowing both, the said work surface and the said back to fold flat. The work station can be made of riged sheet material. Mounted near the top of the work surface 10, are two book holders 22, used to hold the reading material in place against the back support 14.

1 Claim, 1 Drawing Sheet

FIG. 1
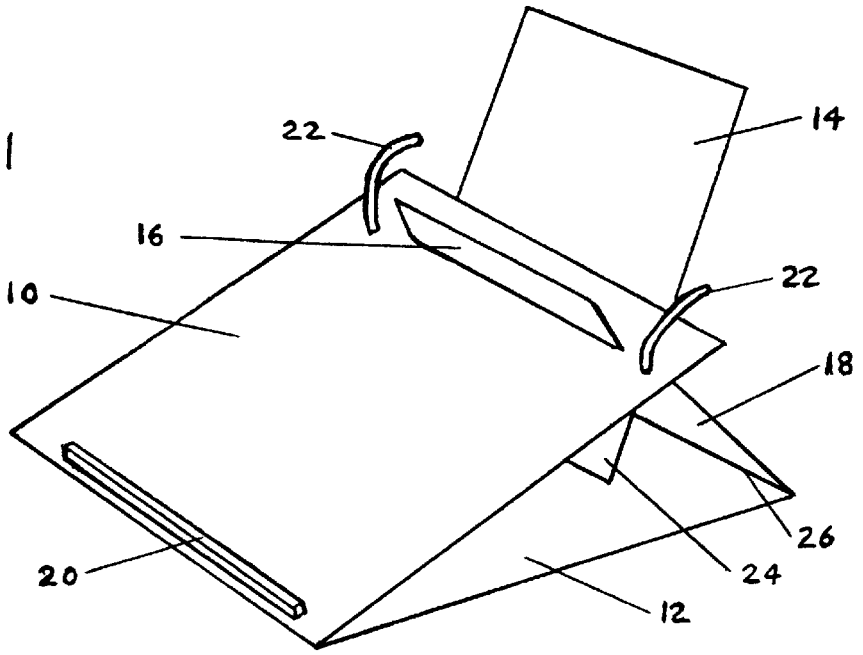
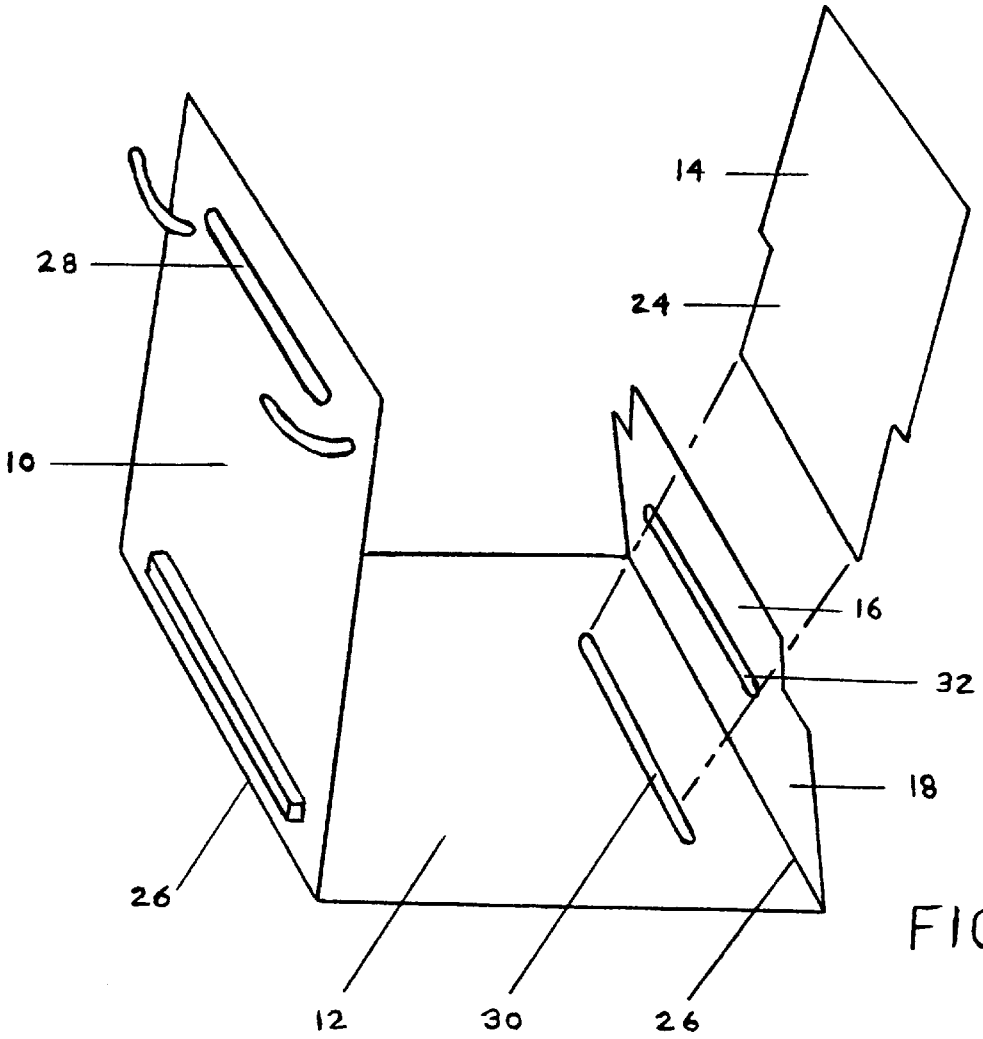
FIG. 2

COLLAPSIBLE WORK STATION DEVICE

BACKGROUND

1. Field of Invention

This Invention simultaneously, holds reading materials and provides a slanted work surface, and folds flat when not in use.

2. Description of Prior Art

Heretofore book holders did not provide a writing surface combined with a book holder that would fold flat. Other reading and writing aids did not have a flat bottom that would allow a person to place it on their lap. The lap desk did not provide a book support and a separate writing surface.

Thereafter, inventors created several types of sheet holders and book stands that were not a combination book holder and writing surface, that could be used on a person's lap or table top and fold flat for easy storage. U.S. Pat. No. D365,461 to Falter discloses a lap top desk that can't be knocked down. Many other lap top desks have been proposed-for example, U.S. Pat. Nos. D354,636 to Cable, D341,958 to Allred and D316,727 to Greenspahn, have no flat bottom. The bottom of these lap top units are irregular, thus allowing edges that could hurt a person's legs. U.S. Pat. No. D328,985 to Sheldon does not include a book holder and cannot be folded. Most lap top desk do not include a device to hold the book's pages.

OBJECTS AND ADVANTAGES

Accordingly besides the objects and advantages of a combination work station described in my above patent, several objects and advantages of the present invention are:

(a) to provide a collapsible work station that can be constructed from light weight material so it can be easily carried.

(b) to provide a collapsible work station that can be constructed of most types of readily available sheet plastics, hard boards, foam boards and card boards that can be coated with vinyl or other resins.

(c) to provide a collapsible work station with a removable back support when only the slanted work surface is needed.

(d) to provide a collapsible work station which is easy to set up and fold down for storage and stacking on top of each other.

(e) to provide a collapsible work station which reduces eye strain and fatigue for people doing research or studying.

(f) to provide a collapsible work station that includes two flexible rods that can hold the pages of a book or other work.

Further objects and advantages are to provide a collapsible work station that will make life easier for handicapped students who cannot hold a book and write at the same time, and those people with poor eyesight who need this aid to see their work.

DRAWING FIGURES

FIG. 1 is an isometric of my invention showing the collapsible work station in the assembled set up mode.

FIG. 2 is an exploded view showing the collapsible work station partly opened up, and ready to assemble, with the, upright support lined up to the grooves it fits into.

REFERENCE NUMERALS IN DRAWINGS

| | |
|---|---|
| 10. work surface | 12. base |
| 14. back support | 16. tab extension of back |
| 18. back | 20. rest |
| 22. book holder | 24. support tab |
| 26. hinge | 28. slot to receive back tab |
| 30. lower back support slot | 32. upper back support slot |

SUMMARY

In accordance with the present invention, a collapsible work station device, that can hold reading material and simultaneously provide an easy to see slanted work surface.

DESCRIPTION—FIGS. 1 AND 2

In FIG. 2 we see how each part work surface 10, base 12 and back 18 are connected to each other with hinges 26. The nice feature is that the parts work surface 10, base 12 and back 18 could be connected to each other by application of a vinyl laminating coating, that would allow flexing of each part at the hinge 26 joint area, instead of mechanical hinges. The slots 28, 30, and 32 could be made prior to assembly. All parts could be made of the same material, or each part could be made of different strength material as required by the user. Common materials such as sheet plastic, card board, hard board, or any other rigid sheet material could form this work station. The back support 14 would be made independent of the other parts, and could be made of the same materials as the other parts.

In FIG. 1 the inclined work surface 10 should be large enough to support a three ring binder note book. Attached to the lower edge of the work surface is a strip of material, one quarter inch square, forming a rest 20. The book holders 22 are made of flexible material, rigid enough, so when bent towards a book, these holders will hold the book pages from turning. Said book holders should be about four inches long, and would attach to the work surface 10. The tab 16 holds a book or other material against the back support in such a way so the material cannot slide down the work surface. This work station can be made into many different sizes, to accommodate different task, and to adapt to a person's disability or needs.

OPERATION—FIGS. 1 AND 2

This collapsible work station can be folded to a compact easy to carry and store size by performing the following operations:

(a) In FIG. 1, pull the back support 14 up and out of lower back support slot, 30 as shown in FIG. 2, and the upper back support slot 32.

(b) Place the back support 14 flat on top of the base 12.

(c) Lift work surface 10 up a few inches until the tab extension 16 is out of the slot to receive the back tab 28 FIG. 2.

(d) Lay the back 18 down flat on top of the back support 14.

(e) Fold the work surface 10 down on top of the back 18.

FIG. 2 shows the relationship of the moving parts, the work surface 10 and the back 18, which are hinged 26 to base 12. To set up a collapsed work station, you need to lift the work surface 10 with one hand and rotate the back 18 upwards with the other hand until the tab extension 16 lines up with slot 28, then lower the work surface 10 until the tab extension 16 is completely through slot 28. You will now feel the work surface 10 resting on the shoulders of the tab extension 16. This forms a rigid work surface that uses the principle of a triangle to brace itself in all directions as shown in FIG. 1.

Should a person need to use the back support 14, as shown in FIG. 2, guide the support tab 24 through the upper back support slot 32 and the lower back support slot 30. This will lock the back support 14 into the back 18 and the base 12, keeping the back support 14 tightly against the upper edge of the work surface 10. The tab extension 16 serves two purposes; locks the work surface 10 to the back 18, and keeps the items that are stood up against the back support 14 from sliding down the work surface 10. The advantage of this design is when a person is not using the back support 14, this said support can be stored out of the way by sliding it into the open side of the triangular shaped work station device, so that this said support will rest flat on the base 12.

The work surface 10 can be used as a writing surface, a work surface, or a reading surface. A person can place a book on the work surface 10 and place another book or other material against the back support 14 so two books or items can be studied at the same time. The book holders 22 are attached to the work surface 10. The book holder 22 can be moved to hold a book or other items in place against the back support 14. These book holders 22 are flexible when moved and remain stationary when put into desired position.

SUMMARY, RAMIFICATIONS, AND SCOPE

Obviously the collapsible nature of this work station device makes it portable, so that it can be utilized in unlimited uses, and locations. Some of the specific advantages of the collapsible work station are as follows:

it is easy to set up and knock down.

it is compact when folded down flat for convenient storage, packing and shipping.

it can be hand carried or will fit into a suitcase for travel.

it can be set on a table top, a person's lap or any suitable area where needed.

it can be easily manufactured and assembled.

it can be made of most readily available sheet materials.

it allows for a removable book support when only the work surface is needed.

it can hold two books or other items simultaneously.

it reduces your eye strain and fatigue by elevating the reading or work material to a more comfortable viewing angle.

While the above description contains many specifications, these should not be construed as limitations on the scope of the invention, but rather as a starting point for many other uses. People of all ages and all walks of life could easily use this invention. Examples would include many uses, such as writing checks on the work surface while the bills are propped up against the back support for easy viewing, and as an aid for people with handicaps.

Thus the scope of the invention should be determined by the appended claims and their legal equivalents, rather than by the examples given.

I claim:

1. A collapsible work station device comprising:

(a) a planar surface of rigid material of sufficient size to accommodate use by a human being for writing and working, (b) a planar back member with a slot and of sufficient size to elevate said work surface to desired angle of incline, (c) a planar base with means for pivoting from opposite edges said work surface and said back enabling rotation to form a triangular configuration, (d) an unattached sheet of rigid material that slides through said slot in planar back to be able to support articles upright above said work surface.

* * * * *